US009889450B2

(12) United States Patent
She et al.

(10) Patent No.: US 9,889,450 B2
(45) Date of Patent: Feb. 13, 2018

(54) POWDER CLASSIFICATION SYSTEM AND METHOD

(71) Applicant: United Technologies Corporation, Farmington, CT (US)

(72) Inventors: Ying She, East Hartford, CT (US); Aaron T. Nardi, East Granby, CT (US); Michael A. Klecka, Coventry, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 15/100,892

(22) PCT Filed: Dec. 4, 2014

(86) PCT No.: PCT/US2014/068596

§ 371 (c)(1),
(2) Date: Jun. 1, 2016

(87) PCT Pub. No.: WO2015/094694

PCT Pub. Date: Jun. 25, 2015

(65) Prior Publication Data

US 2016/0303578 A1 Oct. 20, 2016

Related U.S. Application Data

(60) Provisional application No. 61/917,461, filed on Dec. 18, 2013.

(51) Int. Cl.

| | |
|---|---|
| ***B03B 9/06*** | (2006.01) |
| ***B03B 4/06*** | (2006.01) |
| ***B03B 9/00*** | (2006.01) |

(52) U.S. Cl.
CPC . *B03B 4/06* (2013.01); *B03B 9/00* (2013.01)

(58) Field of Classification Search
CPC ..... B03B 4/00; B03B 4/06; B03B 9/00
(Continued)

(56) References Cited

U.S. PATENT DOCUMENTS 4,287,088 A 9/1981 Sirkar
4,421,594 A * 12/1983 Bildjukevich ..... B01D 1/18 159/16.1

(Continued)

FOREIGN PATENT DOCUMENTS

GB 2121670 A 1/1984

OTHER PUBLICATIONS

International Search Report and Written Opinion, for PCT Application No. PCT/US2014/068596, dated Mar. 12, 2015, 28 pages.

(Continued)

*Primary Examiner* — Terrell H Matthews
(74) *Attorney, Agent, or Firm* — Kinney & Lange, P.A.

(57) ABSTRACT

A powder classification apparatus (10; 110; 210) includes a first chamber (12; 112; 212) that includes a fluidized bed and has an inlet (16; 116; 216A) and an outlet (18; 118; 218), the inlet (16; 116; 216A) configured to receive a gas (G) and distribute the gas (G) in a uniform flow through the first chamber (12; 112; 212), the first chamber (12; 112; 212) configured to receive a powder (P) and the gas (G) and create a fluidization zone, the outlet (18; 118; 218) configured to allow at least a portion of the powder (P) to exit the first chamber (12; 112; 212); and a second chamber (14; 114; 214) having a powder inlet (24; 124; 224) configured to accept at least a portion of the powder (P) from the outlet (18; 118; 218) in the first chamber (12; 112; 212) caused by at least a portion of the powder (P) being ejected from the first chamber (12; 112; 212) by the gas (G).

20 Claims, 3 Drawing Sheets

(58) Field of Classification Search
USPC ..... 209/11, 138, 139.1, 710
See application file for complete search history.

(56) References Cited

U.S. PATENT DOCUMENTS 4,589,981 A 5/1986 Barari et al.
4,946,653 A 8/1990 Stopp et al.
5,165,549 A * 11/1992 Kanda ..... B07B 7/086 209/135
5,366,094 A 11/1994 Stein
5,867,921 A * 2/1999 Maruyama ..... F26B 3/084 34/360
5,975,309 A * 11/1999 Mitsuda ..... B03B 4/00 209/138
6,253,465 B1 * 7/2001 Ichitani ..... B01J 8/36 209/139.1
6,684,917 B2 * 2/2004 Zhu ..... B01J 8/0015 141/18
8,540,174 B2 * 9/2013 Makino ..... B02C 19/065 241/19
9,211,547 B2 * 12/2015 Latta ..... B02C 23/12
2004/0000235 A1 1/2004 Oshitani et al.
2006/0163118 A1 7/2006 Kelsey et al.
2007/0040056 A1 2/2007 Weidhaus
2011/0308437 A1 * 12/2011 Latta ..... B07B 7/01 110/232
2014/0021109 A1 * 1/2014 Kozawa ..... B07B 7/08 209/710

OTHER PUBLICATIONS

Written Opinion and International Search Report, for PCT Application No. PCT/US2014/068596, dated Jul. 7, 2016, 11 pages.
Extended European Search Report for EP Application No. 14871085.8, dated Jul. 14, 2017, 7 pages.

* cited by examiner

POWDER CLASSIFICATION SYSTEM AND METHOD

BACKGROUND

The present invention relates generally to the field of additive manufacturing and, in particular, to pretreatment and classification of powders used in additive manufacturing processes.

Additive manufacturing is an established but growing technology. In its broadest definition, additive manufacturing is any layerwise construction of articles from thin layers of feed material. Additive manufacturing may involve applying liquid, layer, or particle material to a workstage, then sintering, curing, melting, and/or cutting to create a layer. The process is repeated up to several thousand times to construct the desired field finished component or article.

SUMMARY

A powder classification apparatus includes a first chamber that includes a fluidized bed and has an inlet and an outlet, the inlet configured to receive a gas and distribute the gas in a uniform flow through the first chamber, the first chamber configured to receive a powder and the gas and create a fluidization zone, the outlet configured to allow at least a portion of the powder to exit the first chamber; and a second chamber having a powder inlet configured to accept at least a portion of the powder from the outlet in the first chamber caused by at least a portion of the powder being ejected from the first chamber by the gas.

A method of classifying a powder includes introducing a powder into a fluidized bed, the fluidized bed having an inlet and an outlet; flowing a gas into the fluidized bed through the inlet to form a uniform flow across the surface area of the fluidized bed causing the powder to become suspended in the gas; and collecting a specific size, shape, or density of the powder that is ejected from the fluidized bed by the gas.

DETAILED DESCRIPTION

Often times, it is necessary to clarify or sort raw powder into various sizes, shapes, and/or densities before it is used in an additive manufacturing process. A finished component or article may be more precisely constructed if the powder used at a particular stage is consistent in size, shape. and/or density. Additionally, it may be easier to pretreat the powder if the powder is first classified into groups of similar size, shape and/or density.

Figure 1:
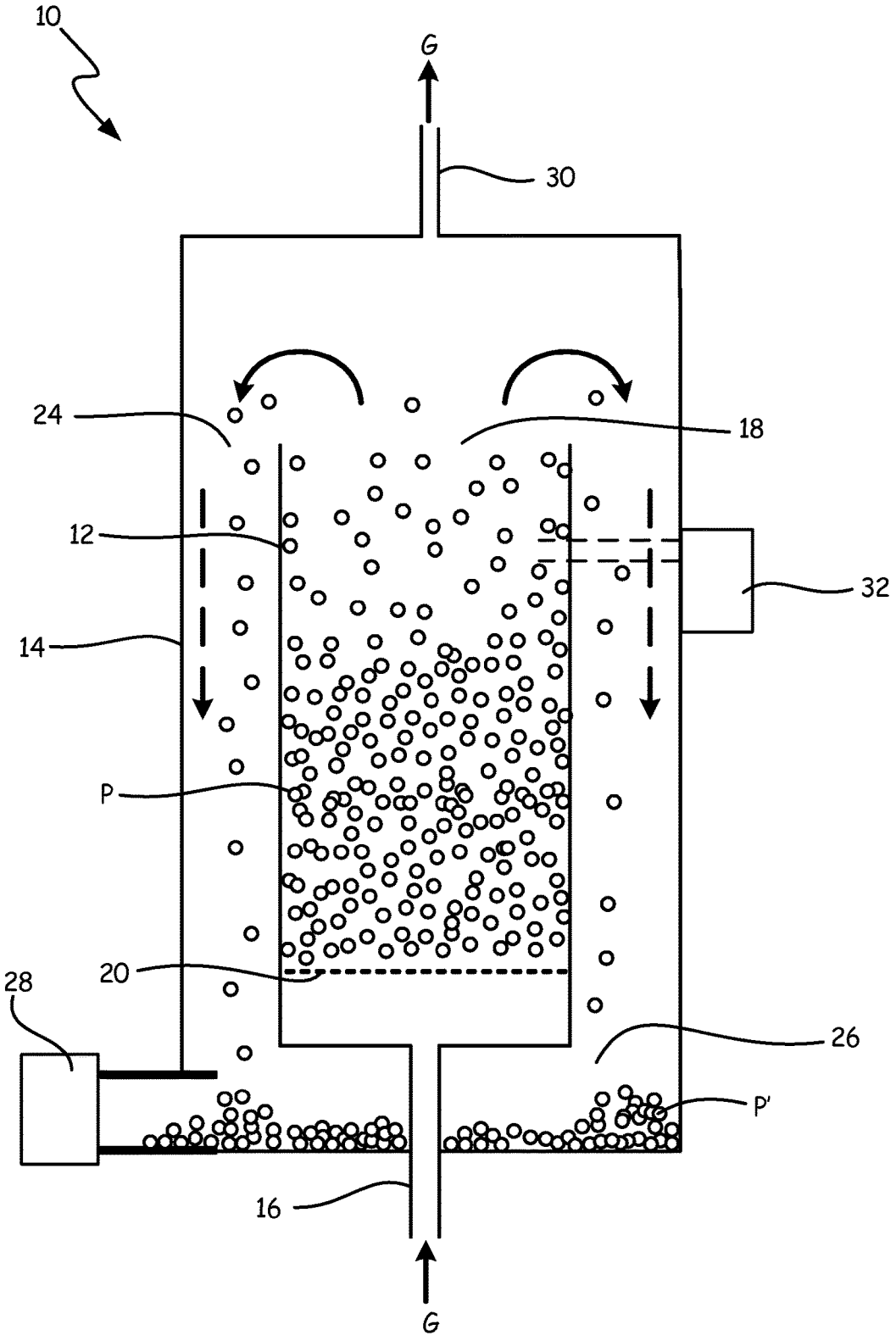
FIG. 1 is a cross-section view of a first embodiment of a powder classification apparatus.

FIG. 1 is a cross-section view of a first embodiment of a powder classification apparatus. Powder classification apparatus 10 includes first chamber 12, which also may be called a fluidized bed, and second chamber 14. First chamber 12 includes gas inlet 16, powder outlet 18, and flow regulator 20. Second chamber 14 includes powder inlet 24, collection zone 26, and powder collector 28. Within powder classification apparatus 10 may also be powder P and gas G.

Powder classification apparatus 10 may also include gas outlet 30 and heat treatment device 32.

One purpose of powder classification apparatus 10 is to classify (or sort) powder P, which is within first chamber 12 when the classification process begins. Powder P includes particles of various sizes, shapes, and/or densities. As the classification process progresses, powder P is classified such that the smaller and/or less dense particles (designated P') with lower drag coefficients are ejected from first chamber 12 and the larger and/or more dense particles (designated P) with higher drag coefficients remain within first chamber 12 (when discussing the powder in general or the powder within first chamber 12, the designation P will be used; when discussing the smaller and/or less dense particles with lower drag coefficients that were ejected from first chamber 12, the designation P' will be used).

First chamber 12 is a fluidized bed that may be cylindrical or another shape that allows for a uniform gas flow upward through first chamber 12. At the bottom of first chamber 12 is gas inlet 16, which introduces gas G into first chamber 12. Adjacent to gas inlet 16 is flow regulator 20, which turns gas G that is introduced into first chamber 12 by gas inlet 16 into a uniform gas flow across the surface area of first chamber 12. The uniform gas flow created by flow regulator 20 flows upward through first chamber 12, causing powder P within first chamber 12 to become suspended. At the top of first chamber 12 is powder outlet 18, which is an opening in first chamber 12 that allows a specific size, shape, and/or density of powder P to exit first chamber 12.

Surrounding first chamber 12 is second chamber 14, which may be annular or another shape that is able to collect the specific size, shape, and/or density of powder P' that exits first chamber 12 through powder outlet 18. Powder inlet 24 is an opening at the top of second chamber 14 and is adjacent to powder outlet 18 of first chamber 12 such that if powder P' exits first chamber 12 it will flow into second chamber 14. Within second chamber 14 is collection zone 26, which is near the bottom of second chamber 14 and is where powder P' within second chamber 14 accumulates after powder P' exits first chamber 12. Adjacent to collection zone 26 is powder collector 28, which may remove powder P' from second chamber 14 so powder P' can go through further pretreatment or be used in the additive manufacturing process.

Heat treatment device 32 may extend through the sides of first chamber 12 and second chamber 14 to allow for heat to be introduced into powder classification apparatus 10 for heat treatment of powder P. Additionally, heat treatment device 32 may surround powder classification apparatus 10 such that powder classification apparatus 10 is within a heated atmosphere, which may be a furnace or similar device. Also, heat treatment device 32 may be placed near gas inlet 16 so as to heat gas G before it is introduced into first chamber 12. Heat treatment device 32 may be a heater or can be another device that heats gas G as it is introduced into powder classification apparatus 10. At the top of powder classification apparatus 10 is gas outlet 30, which allows for gas G to exit powder classification apparatus 10 so as to prevent a buildup of pressure within powder classification apparatus 10.

Powder P having various sizes, shapes, and/or densities and desired to be classified for an additive manufacturing process is introduced into first chamber 12. Powder P may be one material with various sizes and shapes or may be a number of materials having different sizes, shapes, and/or densities. Powder P begins within first chamber 12, where it is acted upon by the uniform flow of gas G flowing upward through first chamber 12. Gas G is introduced into first chamber 12 by gas inlet 16. Gas G may be a number of different gases suitable for acting upon powder P, but may also be a noble gas, such as argon, or a gas selected in order to degas/clean powder P as it comes into contact with powder P through the fluidization process (the process that suspends powder P; the area where the suspension takes place may be called a fluidized bed). After flowing into first chamber 12 through gas inlet 16, gas G is acted upon by flow regulator 20. Flow regulator 20 is a gas distributor configured to turn gas G into a uniform flow across the surface area of first chamber 12. While FIG. 1 shows flow regulator 20 located at the bottom of first chamber 12, flow regulator 20 may also be located within gas inlet 16. Uniform flow upward in first chamber 12 is desired so as to ensure powder P is consistently dispersed through first chamber 12. The size and/or shape of first chamber 12 may also be altered to create a uniform flow through first chamber 12. Flow regulator 20 may be a tent, porous plate, cap, or other configuration, but should have openings smaller than the smallest sized particles of powder P so as to prevent flow regulator 20 from becoming clogged by powder P.

The uniform flow of gas G through first chamber 12 creates a fluidized bed that suspends powder P within first chamber 12. The uniform flow of gas G through first chamber 12 will cause the different particles of powder P having different drag coefficients (due to differing size, density, and/or surface areas) to be suspended at different heights within first chamber 12. Depending on the size, shape (surface area), and/or density of the particles of powder P, some particles of powder P will be suspended near the bottom of first chamber 12, near the top of first chamber 12, or ejected from first chamber 12. The heavier and denser particles of powder P with higher drag coefficients will be more resistance to being lifted by the uniform flow and the closer those particles of powder P will be to the bottom of first chamber 12. The lighter and less dense particles of powder P with lower drag coefficients will be less resistance to being lifted by the uniform flow and the closer those particles of powder P will be to the top of first chamber 12. Additionally, the shape of the particles of powder P can also influence where the particle of powder P is suspended, for round particles have less drag (and therefore will be suspended higher in first chamber 12) and sharp/jaggedly shaped particles have more drag (and therefore will be suspended lower in first chamber 12).

Depending on the rate of the uniform flow, the type of gas G used, the size of the particles of powder P, the shape of the particles of powder P, and/or the density of the particles of powder P, powder classification apparatus 10 can be adjusted to selectively eject a specific size, shape, and/or density of the particles of powder P out of first chamber 12 through powder outlet 18. Powder P would be sorted such that the smaller and/or less dense particles of powder P with lower drag coefficients would be ejected from first chamber 12 (designated by P') and the larger and/or more dense particles (designated by P) with higher drag coefficients would remain behind in first chamber 12. Therefore, powder P would be classified into groups depending on its properties, most notably the size, shape, and/or density of the particles of powder P.

Powder P' that is ejected from first chamber 12 flows out through powder outlet 18. At this point, powder P' is not acted upon by the uniform flow sufficiently to cause powder P' to be suspended. In this situation, gravity causes the particles of powder P' to settle and enter second chamber 14 through powder inlet 24. Second chamber 14 is adjacent to first chamber 12 and can be a variety of different shapes, including an annular configuration that is radially outward from first chamber 12. The uniform flow of gas G within first chamber 12 is not present within second chamber 14, so powder P' is able to settle to the bottom of second chamber 14 and into collection zone 26. Collection zone 26 may include powder collector 28, which collects powder P' that was ejected from first chamber 12 and settled into collection zone 26. Powder collector 28 may be a sweeping assembly, suction mechanism, or other device able to remove powder P' from collection zone 26. After leaving collection zone 26, powder P' may go on to further pretreatment or may be used directly in an additive manufacturing process or another process.

Powder P may also be heated by heat treatment device 32 within first chamber 12 or second chamber 14 so as to heat treat powder P without sintering powder P. Heat treatment device 32 may be any device that introduces a desired amount of heat into powder classification apparatus 10 and can be located anywhere throughout powder classification apparatus 10. As mentioned above, heat treatment device 32 may surround powder classification apparatus 10 or may also be located so as to heat gas G before it is introduced into first chamber 12.

At the top of powder classification apparatus 10 is gas outlet 30, which is configured to allow gas G introduced into first chamber 12 by gas inlet 16 to escape powder classification apparatus 10. Gas outlet 30 is positioned to prevent powder P from exiting powder classification apparatus 10 through gas outlet 30. Because gas G is allowed to escape powder classification apparatus 10 through gas outlet 30, gas G does not build up within powder classification apparatus 10 and the pressure within powder classification apparatus 10 can be regulated and adjusted.

Powder classification apparatus 10, through the use of a fluidized bed within first chamber 12, has the ability to sort specific sizes, shapes, and/or densities of particles of powder P, which is advantageous when powder P is intended to be used in an additive manufacturing process that requires a consistent powder having a specific size, density, and/or other properties. Additionally, the use of a suitable gas within powder classification 10 can degas and clean powder P so that the contaminants or inconsistences of powder P are removed before being used. Finally, powder P may be heat treated within powder classification apparatus 10 to give it desired properties suited for its specific use. Therefore, powder classification apparatus 10 can classify and treat powder P so as to prepare it for its intended use in the additive manufacturing process. Powder classification apparatus 10 is flexible enough to be useful in the laboratory to classify and prepare a small portion of powder P or may be enlarged into a commercial process to classify and prepare a large portion of powder P.

Figure 2:
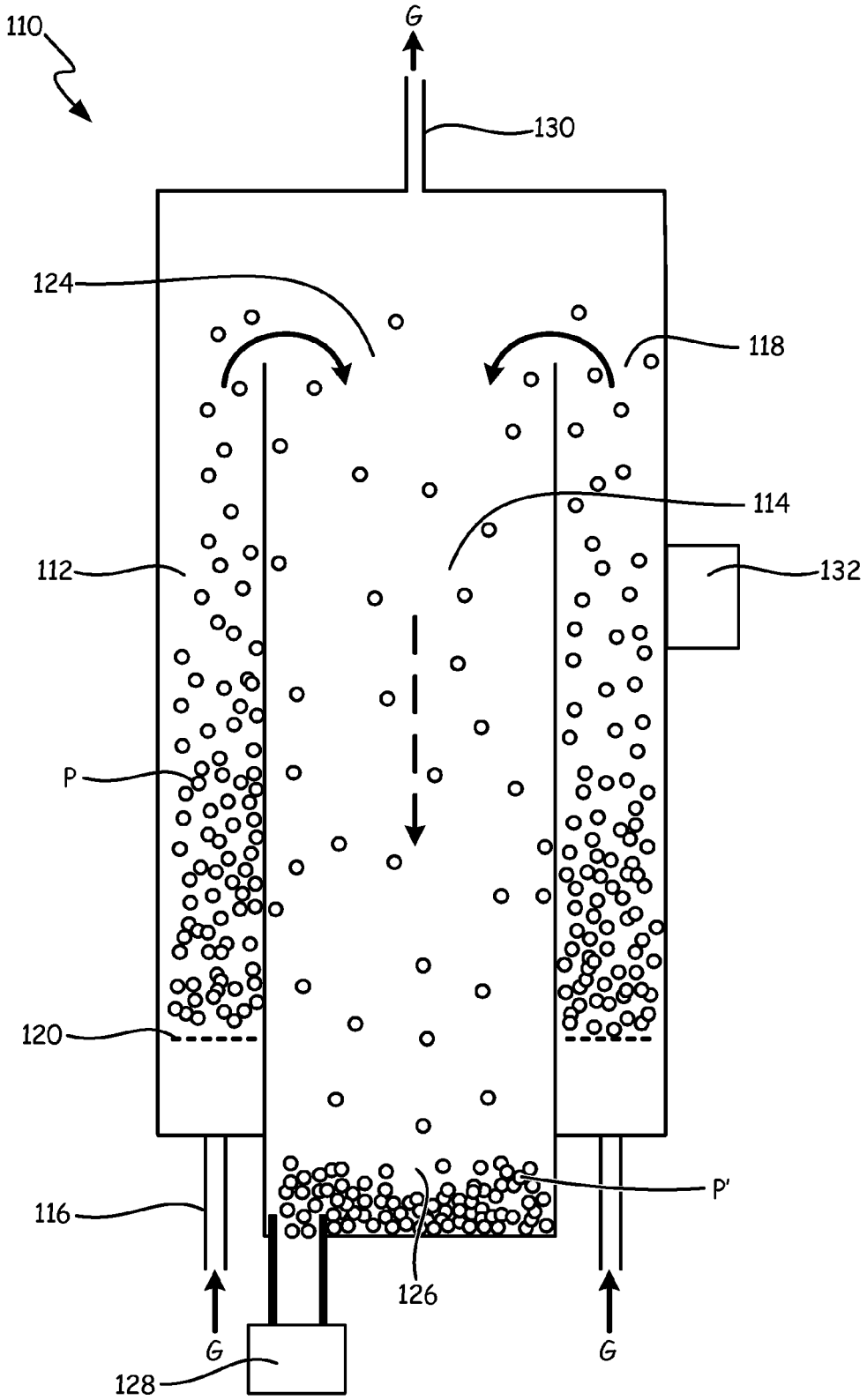
FIG. 2 is a cross-section view of a second embodiment of a powder classification apparatus.

FIG. 2 is a cross-section view of a second embodiment of a powder classification apparatus. Powder classification apparatus 110 includes first chamber 112, which also may be called a fluidized bed, and second chamber 114. First chamber 112 includes gas inlet 116, powder outlet 118, and flow regulator 120. Second chamber 114 includes powder inlet 124 collection zone 126, and powder collector 128. Within powder classification apparatus 110 may be powder P. Powder classification apparatus 110 may also include gas outlet 130 and heat treatment device 132.

Powder classification apparatus 110 functions similar to powder classification apparatus 10 of FIG. 1 in that it uses a fluidization process to classify powder P into specific sizes, shapes, and/or densities (with P' designating the smaller and/or less dense particles with lower drag coefficients that have been ejected from first chamber 112), except that second chamber 114 can be cylindrical or another shape with first chamber 112 surrounding second chamber 114. First chamber 112 may be a cylinder with second chamber 114 also a cylinder radially within first chamber 114. Powder classification apparatus 110 has all of the advantageous of the apparatus of FIG. 1. Additionally, while powder classification apparatus 110 shows first chamber 112 adjacent to both sides of second chamber 114, first chamber 112 may be a rectangle or another shape that is adjacent only to one side of second chamber 114. Also, while second chamber 114 of FIG. 2 is shown to have a bottom that extends below the bottom of first chamber 112, similar configurations allow for the bottoms for first chamber 112 and second chamber 114 to be aligned.

Figure 3:
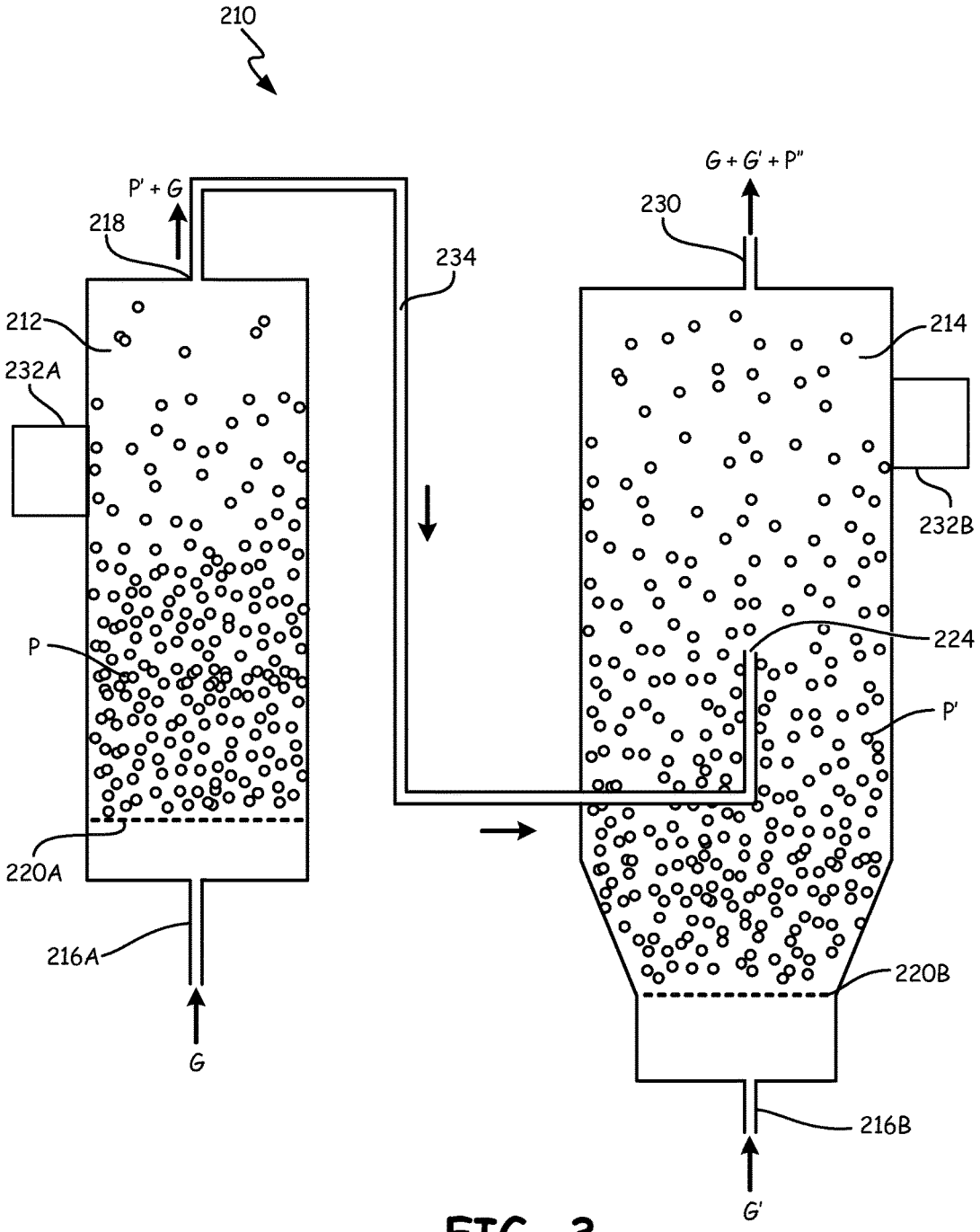
FIG. 3 is a cross-section view of a third embodiment of a powder classification apparatus.

FIG. 3 is a cross-section view of a third embodiment of a powder classification apparatus. Powder classification apparatus 210 includes first chamber 212 and second chamber 214, both of which may be fluidized beds. First chamber 212 includes gas inlet 216A, powder outlet 218, and flow regulator 220A. Second chamber 214 includes gas inlet 216B, flow regulator 220B, powder inlet 224, and outlet 230. Within powder classification apparatus 210 may be powder P and P' and P". Powder classification apparatus 210 may also include heat treatment devices 232A and 232B. Between first chamber 212 and second chamber 214 is transfer tube 234.

One purpose of powder classification apparatus 210 is to classify powder P, which is within first chamber 212 when the classification process begins. Powder P includes particles of various sizes, shapes, and/or densities having different drag coefficients. As the classification process progresses, powder P is classified such that the smaller and/or less dense particles (designated P') with lower drag coefficients are ejected from first chamber 112 and the larger and/or more dense particles (designated P) with higher drag coefficients remain within first chamber 112. As the classification process progresses further, powder P' in second chamber 214 is classified such that the smallest and/or least dense particles (designated P") with the lowest drag coefficients are ejected from second chamber 214 (when discussing the powder in general or the powder within first chamber 112, the designation P will be used; when discussing the smaller and/or less dense particles that were ejected from first chamber 112, the designation P' will be used; and when discussing the smallest and/or least dense particles that were ejected from second chamber 114, the designation P" will be used).

Powder classification apparatus 210 functions similarly to the apparatuses of FIG. 1 and FIG. 2 in that powder classification apparatus 210 has the ability to classify or sort powder P depending on size, density, and/or other properties of the particles of powder P.

First chamber 212 is a fluidized bed that may be cylindrical or another shape that allows for a uniform gas flow upward through first chamber 212. At bottom of first chamber 212 is gas inlet 216A, which introduces gas G into first chamber 212. Adjacent to gas inlet 216A is flow regulator 220A, which is a gas distributor that turns gas G that is introduced into first chamber 212 by gas inlet 216A into a uniform gas flow across the surface area of first chamber 212. While FIG. 3 shows flow regulator 220A located at the bottom of first chamber 212, flow regulator 220A may also be located within gas inlet 216A. The uniform gas flow created by flow regulator 220A flows upward through first chamber 212, causing powder P within first chamber 212 to become suspended. At the top of first chamber 212 is powder outlet 218, which is an opening in first chamber 212 that allows a specific size, shape, and/or density of powder P' to exit first chamber 212. While powder outlet 218 does not span the total width of first chamber 212 in FIG. 3, powder outlet 218 may be as large as needed to allow for powder P' to exit first chamber 212.

Connected to powder outlet 218 is transfer tube 234, which allows powder P' that has exited first chamber 212 to flow into second chamber 214 through powder inlet 224. Transfer tube 234 may be any configuration that allows powder P' to move from first chamber 212 to second chamber 214. Transfer tube 234 may also transfer gas G within first chamber 212 to second chamber 214.

Second chamber 214 may be a collection zone for powder P' that has exited first chamber 212 or may be a fluidized bed similar to first chamber 212 that further classifies powder P' into a larger and/or denser powder P' and a smaller and/or less dense powder P". Second chamber 214 may be cylindrical or another shape that allows for a uniform gas flow upward through second chamber 214. At the bottom of second chamber 214 is gas inlet 216B, which may introduce gas G' into second chamber 214. Adjacent to gas inlet 216B is flow regulator 220A, which is a gas distributor that turns gas G' that is introduced into second chamber 214 by gas inlet 216B into a uniform gas flow across the surface area of second chamber 214. While FIG. 3 shows flow regulator 220B located at the bottom of second chamber 214, flow regulator 220B may also be located within gas inlet 216B. The uniform gas flow created by flow regulator 220B flows upward through second chamber 214, causing powder P' introduced into second chamber 214 by transfer tube 234 through powder inlet 224 to become suspended. At the top of second chamber 214 is outlet 230, which is an opening in second chamber 214 that allows gas G to exit when second chamber 214 is not a fluidized bed or allows gas G and G' and a specific size, shape, and/or density of powder P" to exit when second chamber 214 is a fluidized bed. Outlet 230 allows for gas G and G' to exit powder classification apparatus 210 so as to prevent a buildup of pressure within powder classification apparatus 210.

Heat treatment device 232A and 232B may be positioned throughout powder classification apparatus 210, including heat treatment device 232A that is present within first chamber 212 or heat treatment device 232B that is present within second chamber 214. Additionally, heat treatment device 232A and 232B may surround powder classification apparatus 210 such that powder classification apparatus 210 is within a heated atmosphere, which may be a furnace or similar device. Also, heat treatment device 232A may be placed near gas inlet 216A and/or heat treatment device 232B may be placed near gas inlet 216B so as to heat gas G and/or G' before it is introduced into first chamber 212 and/or second chamber 214. Heat treatment device 232A and 232B may be a heater or can be another device that heats gas G and/or G' as it is introduced into powder classification apparatus 210. Heat treatment device 232A and 232B could be used to pretreat powder P so as to prepare powder P for the additive manufacturing process.

Powder P having various sizes, shapes and/or densities and desired to be classified for an additive manufacturing process is introduced into first chamber 212. Powder P may be one material with various sizes and shapes or may be a number of materials having different sizes, shapes, and/or densities. Powder P begins within first chamber 212, where it is acted upon by the uniform flow of gas flowing upward through first chamber 212. Gas G is introduced into first chamber 212 by gas inlet 216A. Gas G may be a number of different gases suitable for acting upon powder P, but may also be a noble gas, such as argon, or a gas selected in order to degas/clean powder P as it comes into contact with powder P through the classification process. After flowing into first chamber 212 through gas inlet 216A, gas G is acted upon by flow regulator 220A. Flow regulator 220A is configured to turn gas G into a uniform flow across the surface area of first chamber 212. Uniform flow upward in first chamber 212 is desired so as to ensure powder P is consistently dispersed through first chamber 212. The size and/or shape of first chamber 212 may also be altered to create a uniform flow through first chamber 212. Flow regulator 220A may be a tent, porous plate, cap, or another configuration, but should have openings smaller than the smallest sized particles of powder P so as to prevent flow regulator 220A from becoming clogged by powder P.

The uniform flow of gas G through first chamber 212 creates a fluidized bed that suspends powder P within first chamber 212. The uniform flow of gas G through first chamber 212 will cause the different particles of powder P having different drag coefficients (due to differing size, density, and/or surface areas) to be suspended at different heights within first chamber 212. Depending on the size, shape (surface area), and/or density of the particles of powder P, the particles of powder P will be suspended near the bottom of first chamber 212, near the top of first chamber 212, or ejected from first chamber 212 through powder outlet 218. The heavier and denser particles of powder P with higher drag coefficients will be more resistance to being lifted by the uniform flow and the closer the particles of powder P will be to the bottom of first chamber 212. The lighter and less dense particles of powder P with lower drag coefficients will be less resistance to being lifted by the uniform flow and the closer the particles of powder P will be to the top of first chamber 212. Additionally, the shape of the particles of powder P can also influence where the particle of powder P is suspended, for round particles have less drag (and therefore will be suspended higher in first chamber 212) and sharp/jaggedly shaped particles have more drag (and therefore will be suspended lower in first chamber 212).

Depending on the rate of the uniform flow, the type of gas G used, the size of the particles of powder P, the shape of the particles of powder P, and/or the density of the particles of powder P, powder classification apparatus 210 can be adjusted to selectively eject a specific size, shape, and/or density of the particles of powder P out of first chamber 212 through outlet 218. Powder P would be sorted such that the smaller and/or less dense particles (designated by P') of powder P would be ejected from first chamber 212 and the larger and/or denser particles (designated by P) would remain behind in first chamber 212. Therefore, powder P would be classified into groups depending on its properties, most notably the size, shape, and/or density of the particles of powder P.

Powder P' that is ejected from first chamber 212 exits through outlet 218 and into transfer tube 234, where those powder P' eventually enters second chamber 214. Gas G flowing through first chamber 212 may also exit first chamber 212 through outlet 218 and flow through transfer tube 234 into second chamber 214. Because of the configuration of first chamber 212, the larger and/or denser particles (powder P) with higher drag coefficients remain within first chamber 212 while the smaller and/or less dense particles (powder P') with lower drag coefficients travel out of first chamber 212 through outlet 218 and into second chamber 214 through transfer tube 234 and powder inlet 224.

When second chamber 214 is used as a collection area for the particles of powder P' ejected from first chamber 212, gas G' is likely not introduced into second chamber 214 through gas inlet 216B, and powder P' in second chamber 214 is allowed to settle to the bottom of chamber 214 where it is collected. In this situation, outlet 230 would only act as an outlet that allows gas G from first chamber 212 to escape.

When second chamber 214 is a fluidized bed, second chamber 214 functions much like first chamber 212, except that the classification process of second chamber 214 ejects a smaller sized and/or less dense particles (powder P") with lower drag coefficients out through outlet 230 than powder P' that first chamber 212 ejected out through powder outlet 218. The size, shape, and/or density of the particles of powder P" that are ejected may depend on the uniform flow (which may be altered by a number of variables, such as the inlet rate, the surface area of second chamber 214), the type of gas G' introduced into second chamber 214 through gas inlet 216B, and other variables in second chamber 214. Therefore, the size and/or density of particles of powder P' that remain in second chamber 214 are between the size and/or density of particles of powder P that remain in first chamber 212 and the size and/or density of particles of powder P" that are ejected out of second chamber 214 through outlet 230. Outlet 230 may then be attached to another device that collects the ejected powder P". Additionally, another embodiment of powder classification apparatus 210 may include the connection of outlet 230 to another transfer tube that leads to a third chamber that functions as a fluidized bed. Such a multi-stage configuration could go on for many chambers so as to classify powder P into a variety of different sizes and/or densities.

Powder inlet 224 should be placed and configured to provide for an even distribution of powder P' across the entire surface area of second chamber 214 and to ensure that gas G coming from first chamber 212 through transfer tube 234 does not affect powder P' in the second chamber 214 drastically so as to cause larger and/or more dense particles of powder P' to be ejected from second chamber 214 than desired.

Gas G' introduced into second chamber 214 through gas inlet 216B may be the same or a different gas than gas G that is introduced into first chamber 212 through gas inlet 216A. The gases may be chosen to degas/clean powder P so as to prepare powder P for its intended use. A different gas may be used in second chamber 214 than that used in first chamber 212 if desired, such as when powder classification apparatus 210 is used to separate at least two different powders with different shapes and/or densities. In that instance, it may be desired to degas/treat the different powders with different gases.

Powder classification apparatus 210 has all of the advantageous of the apparatuses discussed in FIGS. 1 and 2. Additionally, powder classification apparatus 210 allows for multiple classifications of powder P into more than two separate sizes and/or densities with different drag coefficients, which would allow for more powder classes while only introducing the powder into one apparatus. Like with the apparatuses of FIGS. 1 and 2, powder classification apparatus 210 is flexible enough to be useful in the laboratory to classify and prepare a small portion of powder P or may be enlarged into a commercial process to classify and prepare a large portion of powder P.

DISCUSSION OF POSSIBLE EMBODIMENTS

The following are non-exclusive descriptions of possible embodiments of the present invention.

A. powder classification apparatus may include a first chamber that includes a fluidized bed and has an inlet and an outlet, the inlet configured to receive a gas and distribute the gas in a uniform flow through the first chamber, the first chamber configured to receive a powder and the gas and create a fluidization zone, the outlet configured to allow at least a portion of the powder to exit the first chamber; and a second chamber having a powder inlet configured to accept at least a portion of the powder from the outlet in the first chamber caused by at least a portion of the powder being ejected from the first chamber by the gas.

The powder classification apparatus of the preceding paragraph can optionally include, additionally and/or alternatively, any one or more of the following features, configurations, and/or additional components.

A specific size, shape, or density of powder is ejected from the first chamber to the second chamber depending on the rate of flow of the gas into the first chamber, the type of gas used, the size of the particles of powder, the shape of the particles of powder, and/or the density of the particles of powder.

The first chamber is cylindrical in shape and the second chamber is radially outward from first chamber.

The outlet of the first chamber is adjacent to the powder inlet of the second chamber.

The second chamber is cylindrical in shape and the first chamber is radially outward from the second chamber.

A gas outlet in one of the first chamber and the second chamber that is configured to allow the gas to exit the powder classification apparatus.

The second chamber is a fluidized bed having the powder inlet, a gas inlet, and an outlet, the powder inlet configured to accept at least a portion of the powder from the outlet in the first chamber, the gas inlet configured to receive a second gas and distribute the second gas in a uniform flow through the second chamber, the second chamber configured to receive a powder from the first chamber and the second gas and create a fluidization zone, the outlet configured to allow at least a portion of the powder to exit the second chamber.

The first gas and the second gas are the same.

The second chamber includes a powder removal device.

The powder is heat treated through the addition of heat into the powder classification apparatus.

The powder classification assembly may further include a first chamber that includes a fluidized bed, an inlet, and an outlet, the inlet configured to receive a gas and distribute the gas in a uniform flow through the fluidized bed to create a fluidization zone, the fluidized bed configured to receive a powder, the outlet configured to allow at least a portion of the powder to exit the first chamber; and a second chamber having a powder inlet adjacent to the outlet in the first chamber, the powder inlet is configured to accept at least a portion of the powder from the outlet in the first chamber caused by at least a portion of the powder being ejected from the first chamber by the gas.

The powder classification apparatus of the preceding paragraph can optionally include, additionally and/or alternatively, any one or more of the following features, configurations, and/or additional components.

The first chamber is cylindrical and radially within the second chamber.

The second chamber is cylindrical and radially within the first chamber.

The second chamber includes a powder removal device.

A plate with holes is used to distribute the gas in the first chamber in a uniform flow through the fluidized bed in the first chamber.

The holes in the plate have a smaller diameter than the diameter of the powder.

A method of classifying a powder may include introducing a powder into a fluidized bed, the fluidized bed having an inlet and an outlet; flowing a gas into the fluidized bed through the inlet to form a uniform flow across the surface area of the fluidized bed causing the powder to become suspended in the gas; and collecting a specific size, shape, or density of the powder that is ejected from the fluidized bed by the gas.

The method of the preceding paragraph can optionally include, additionally and/or alternatively, any one or more of the following features, configurations, and/or additional components.

The fluidized bed includes a gas outlet.

The specific size, shape, or density of powder is ejected from the fluidized bed in response to the rate of flow of the gas into the fluidized bed, the type of gas used, the size of the powder, and/or the density of the powder.

Introducing heat into the fluidized bed to heat treat the powder.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A powder classification apparatus comprising:

a first chamber that includes a fluidized bed, a gas inlet at a bottom end, a flow regulator adjacent the gas inlet, and a powder outlet at a top end, the gas inlet configured to receive a first gas and distribute the first gas in a uniform flow through the first chamber to create a fluidization zone, the first chamber configured to receive a powder and the first gas, the flow regulator configured to prevent the powder from accessing the gas inlet, and the powder outlet configured to allow at least a portion of the powder to exit the first chamber; and a second chamber having a powder inlet configured to accept at least a portion of the powder from the powder outlet in the first chamber caused by at least a portion of the powder being ejected by the first gas through the powder outlet at the top end of the first chamber.

2. The powder classification apparatus of claim 1, wherein a specific size, shape, or density of powder is ejected from the first chamber to the second chamber depending on the rate of flow of the first gas into the first chamber, the type of gas used, the size of the particles of powder, the shape of the particles of powder, and/or the density of the particles of powder.

3. The powder classification apparatus of claim 1, wherein the first chamber is cylindrical in shape and the second chamber is radially outward from first chamber with the powder inlet of the second chamber at a top end of the second chamber.

4. The powder classification apparatus of claim 3, wherein the powder outlet of the first chamber is adjacent to the powder inlet of the second chamber.

5. The powder classification apparatus of claim 1, wherein the second chamber is cylindrical in shape and the first chamber is radially outward from the second chamber with the powder inlet of the second chamber at a top end of the second chamber.

6. The powder classification apparatus of claim 1, further comprising:

a gas outlet in one of the first chamber and the second chamber that is configured to allow the first gas to exit the powder classification apparatus.

7. The powder classification apparatus of claim 1, wherein the second chamber is a fluidized bed having the powder inlet, a gas inlet, and a powder outlet, the powder inlet configured to accept at least a portion of the powder from the powder outlet in the first chamber, the gas inlet configured to receive a second gas and distribute the second gas in a uniform flow through the second chamber, the second chamber configured to receive a powder from the first chamber and the second gas and create a fluidization zone, the powder outlet of the second chamber configured to allow at least a portion of the powder to exit the second chamber.

8. The powder classification apparatus of claim 7, wherein the first gas and the second gas are the same.

9. The powder classification apparatus of claim 1, wherein the second chamber includes a powder removal device.

10. The powder classification apparatus of claim 1, wherein the powder is heat treated through the addition of heat into the powder classification apparatus.

11. A powder classification assembly comprising:

a first chamber that includes a fluidized bed, a gas inlet at a bottom end, a flow regulator adjacent the gas inlet, and a powder outlet at a top end, the gas inlet configured to receive a gas and distribute the gas in a uniform flow through the fluidized bed to create a fluidization zone, the fluidized bed configured to receive a powder, the powder outlet configured to allow at least a portion of the powder to exit the first chamber, the flow regulator configured to prevent the powder from accessing the gas inlet; and a second chamber having a powder inlet at a top end of the second chamber with the powder inlet being adjacent to the powder outlet at the top end of the first chamber, the powder inlet is configured to accept at least a portion of the powder from the powder outlet in the first chamber caused by at least a portion of the powder being ejected from the first chamber by the gas.

12. The powder classification assembly of claim 11, wherein the first chamber is cylindrical and radially within the second chamber.

13. The powder classification assembly of claim 11, wherein the second chamber is cylindrical and radially within the first chamber.

14. The powder classification assembly of claim 11, wherein the second chamber includes a powder removal device.

15. The powder classification assembly of claim 11, wherein a plate with holes is used to distribute the gas in the first chamber in a uniform flow through the fluidized bed in the first chamber.

16. The powder classification assembly of claim 15, wherein the holes in the plate have a smaller diameter than the diameter of the powder.

17. A method of classifying a powder comprising:

introducing a powder into a fluidized bed, the fluidized bed having a gas inlet at a bottom end, a powder outlet at a top end, and a flow regulator adjacent the gas inlet to prevent the powder from accessing the gas inlet;

flowing a gas into the fluidized bed through the gas inlet to form a uniform flow across the surface area of the fluidized bed causing the powder to become suspended in the gas; and collecting a specific size, shape, or density of the powder that is ejected by the gas from the powder outlet at the top end of the fluidized bed.

18. The method of claim 17, wherein the fluidized bed includes a gas outlet.

19. The method of claim 17, wherein the specific size, shape, or density of powder is ejected from the fluidized bed in response to at least one of the rate of flow of the gas into the fluidized bed, the type of gas used, the size of the powder, the shape of the powder, and the density of the powder.

20. The method of claim 17, further comprising:

introducing heat into the fluidized bed to heat treat the powder.

* * * * *